United States Patent [19]

Olsen

[11] 4,045,108

[45] Aug. 30, 1977

[54] SPRING RETAINER FOR ELECTRIC PLUGS

[76] Inventor: Emil M. Olsen, 642 E. Webster Ave., Ferndale, Mich. 48220

[21] Appl. No.: 764,382

[22] Filed: Jan. 31, 1977

[51] Int. Cl.[2] ..... H01R 13/54

[52] U.S. Cl. ..... 339/75 P; 339/103 R

[58] Field of Search ..... 339/75 P, 91 R, 103 R, 339/36, 39, 82, 106

[56] References Cited

U.S. PATENT DOCUMENTS

| | | | |
|---|---|---|---|
| 2,266,560 | 12/1941 | Mansfield | 339/75 P |
| 2,569,037 | 9/1951 | Dalton | 339/75 P |
| 3,005,176 | 10/1961 | Berg | 339/75 P |
| 3,775,729 | 11/1973 | Casper | 339/75 P |

*Primary Examiner*—Granville Y. Custer, Jr.
*Assistant Examiner*—E. F. Desmond
*Attorney, Agent, or Firm*—William T. Sevald

[57] ABSTRACT

The retainer has a base plate lying between the dual sockets of an electric outlet. The base plate is mounted over the outlet shield and secured with the same screw which secures the shield. Paired flanges extend outwardly from the base plate and a pair of spaced spring legs with feet extend from each of the flanges at an angle. The legs lie parallel to the shield and the feet extend normally inwardly into spring pressed contact with the shield. A plug is inserted into a socket by manually flexing the feet and legs outwardly. Upon plug insertion and release of manual flexing, the legs spring back into engagement with the plug urging it toward inserted position with the feet out of contact with the shield. When one plug is inserted, the unused pair of legs and feet bear against the shield and off-set the levering-twisting at the base plate and screw and aid in exerting force against the inserted plug. When two plugs are inserted, one off-sets the other.

3 Claims, 4 Drawing Figures

SPRING RETAINER FOR ELECTRIC PLUGS

BACKGROUND OF THE INVENTION

Electric sockets are located at many places in houses, farms, stores, offices, factories, etc. so that various electric powered devices such as vacuum cleaners, milkers, display lamps, business machines, power tools, etc. can be plugged into the sockets and powered with electricity.

The universal problem encountered by the users is that when the end of the cord is inadvertantly reached in the use of an electric powered device, when someone tries to walk through the cord, and/or when the plug fits loosely in the socket, for examples, the plug comes out of the socket and the powered devices loose their source of power.

Users have tied or looped the cord around pipes, projections, etc. at the socket to prevent the plug from coming out as an almost universal practice. This tends to break the wire in the cord and it also foreshortens the length of the cord leaving reduced working extension.

Plug retainers of the prior art have not been very satisfactory as they entail mounting the retainer and dismounting the retainer with the securing screw each time a plug is inserted and extracted. This also entails remounting the shield on the sockets each time the screw is removed. Because of the unhandiness of these retainers, they have not found much success in being adopted in general use where plugs are not permanently inserted in the sockets. For the more usual temporary mounting, they have not been used in any significant numbers.

SUMMARY OF THE PRESENT INVENTION

With the foregoing in view, it is an object of the present invention to provide a plug retainer which is permanently mounted on the receptacle and which premits the user to insert and remove plugs without disturbing the permanent mounting so that users will have the ability to insert and remove plugs with almost the same ease as the socket itself without an added retainer.

The retainer has a narrow base plate lying between the dual sockets of an electric outlet. The base plate has a central aperture and is mounted over the outlet shield and secured with the same screw which secures the shield. The base plate has sides at the sockets and paired flanges extend outwardly from the base plate and shield. A pair of spaced apart spring legs with feet extend from each of the flanges at an angle in opposite directions. The legs lie parallel to the shield and the feet extend inwardly toward the shield and normally into spring pressed contact with the shield. A plug is inserted into a socket by manually flexing the feet and legs outwardly and inserting the plug into the socket under the legs. Upon plug insertion and release of manual flexing, the legs spring back into engagement with the plug urging it toward inserted position with the feet out of contact with the shield. When one plug is inserted, the unused pair of legs and feet bear against the shield and off-set the levering-twisting at the base plate and the attaching screw and aid in exerting force against the inserted plug. When two plugs are inserted, one off-sets the other.

These and other objects of the invention will become apparent by reference to the description of the illustrated embodiment taken in connection with the accompanying drawing.

DETAILED DESCRIPTION OF THE ILLUSTRATED EMBODIMENT

Figure 1:
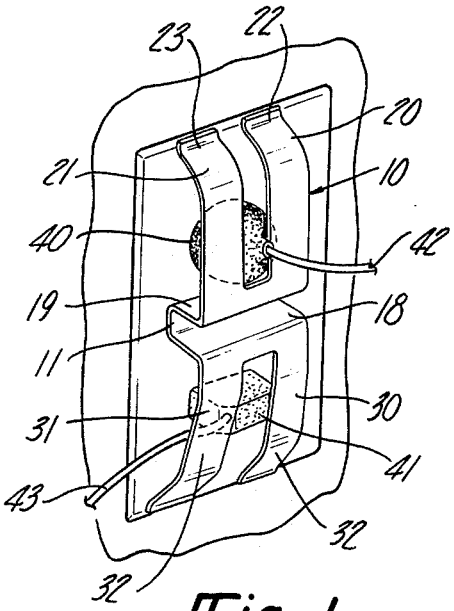
FIG. 1 is a perspective view of an electric outlet shield showing two plugs inserted in broken lines and showing the retainer of the invention in mounted condition on the shield with the legs in spring pressed engagement with the plugs.
Figure 2:
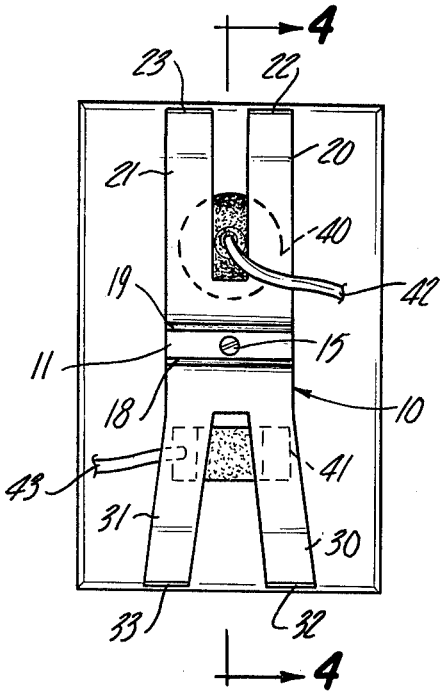
FIG. 2 is a face plan view of the assembly seen in FIG. 1.

Referring now to the drawing wherein like reference numerals refer to like and corresponding parts throughout the several views, a retainer 10 shown therein illustrates a preferred embodiment of the invention and comprises a relatively narrow base plate 11. A central aperture 12 is formed in the base plate 11. The base plate 11 is secured over the shield 14 by removing the screw 15 from the shield 14, inserting it in the aperture 12, and then returning the screw 15 into the shield 14 and the receptacle, behind the shield, now shown. The base plate 11 has opposite lateral sides 16 and 17. Paired upstanding flanges 18 and 19 lead outwardly from the sides 16 and 17 respectively.

Paired spaced spring legs 20 and 21 lead to an angle from the flange 19. The legs 20, 21 lie parallel to and over the shield 14 and are spaced therefrom. Feet 22 and 23 are formed on the legs 20 and 21 respectively. The feet 22 and 23 depend from the legs 20 and 21 and contact the shield 14 when a plug is not inserted. The leg 20 and foot 22 lie parallel to the leg 21 and foot 23 and in sidewise spaced relationship.

Paired spaced spring legs 30 and 31 lead at an outward angle from the flange 18. The legs 30, 31 lie parallel to and over the shield 14 and are spaced therefrom. Feet 32 and 33 are formed on the legs 30, 31 respectively. The feet 32, 33 depend from the legs 30, 31 and contact the shield 14 when a plug is not inserted. The leg 30 and foot 22 and the leg 31 and foot 33 diverge outwardly from one another.

The retainer 10 is made of spring material such as spring steel, stainless steel, spring type synthetic resin or other suitable spring material. The base plate 11 and the flanges 18 and 19 have a comparatively large mass. The legs 20, 21, 30 and 31 and the feet 22, 23, 32 and 33 have a comparatively small mass. The large mass of the base plate 11 and flanges 18 and 19 is relatively compact whereas the small mass of the legs 20, 21, 30 and 31 and the feet 22, 23, 32 and 33 is elongated and spread out. This makes the base plate 11 and flanges 18 and 19 relatively inflexible and the legs 20, 21, 30 and 31 and the feet 22, 23, 32 and 33 relatively flexible. Thus manual flexure in raising the legs and feet to insert a plug results in springing action mainly in the legs and the feet. The flanges 18, 19 and base plate 11 have minimal spring action.

In inserting a plug 40 or 41 in a socket with the retainer 10 mounted over the shield 14, the user manually springs-back the legs and feet and slides the plug 40 or 41 under the legs and feet with the cord leading between the legs 20, 21 as in the case of the cord 42 on the plug 40 or with the cord 43 leading to the side as in the case of the plug 41. The user then inserts the prongs, not shown, on the plug 40, 41 into the sockets of the receptacle, not shown, and releases the manual flexure on the legs and feet which spring back toward the shield 14 and engage the top of the plug 40, 41 urging and holding it in inserted condition.

Figure 3:
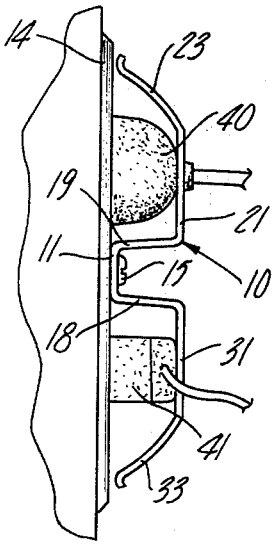
FIG. 3 is a side elevational view of the assembly seen in FIGS. 1 and 2 additionally showing a wall portion broken away and showing the plugs in solid lines.
Figure 4:
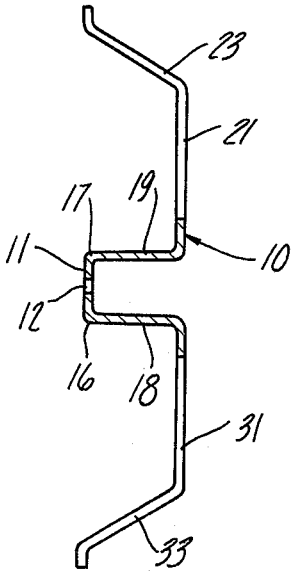
FIG. 4 is a cross-sectional view of the novel retainer taken on the line 4—4 of FIG. 2.

It is to be noted, FIG. 3, that when a plug 40 41 is inserted, that the space between the legs and the shield 14 is designed as less than the height of the plug 40, 41 so that when the legs bear on the plug 40, 41, the feet do not contact the shield 14 leaving the entire spring force of the legs exerted on the plug 40, 41.

In removing a plug 40, 41 the user flexes the legs 20, 21, 30 and 31 outwardly off the plug 40, 41 and then extracts the plug 40, 41 from the sockets of the receptacle.

It will thus be understood from the foregoing, that the retainer 10 is permanently mounted on the shield 14 and need not be removed to insert and extract plugs and that the spring force of the retainer holds the plugs in inserted condition against accidental pulls on the cord. It is also to be noted that the diverging legs 30, 31 provide more lead space between them for the user's fingers and/or for inserting and removing plugs of various sizes.

While a preferred embodiment has been shown and described, modifications of the invention are possible within the terms of the appended claims which define the protective scope of the invention.

I claim:

1. A retainer to hold the plugs of electric cords in the dual sockets of electric power outlets with the outlets surrounded by a rectangular shield having opposite ends and sides and a centrally located attaching screw between the sockets, comprising, a relatively narrow base plate for transversely overlying the shield between the sockets;

said base plate having a central aperture;

said base plate being attached to the outlet by removing the screw from the shield, inserting the screw in the aperture of said base plate, and returning the screw into attached position on the outlet to secure said base plate in a position overlying the shield on the outlet;

said base plate having opposite lateral sides at the dual outlets;

paired upstanding flanges leading from said sides on said base plate and terminating in outer ends;

paired, spaced-apart spring legs leading from the ends of said paired flanges; said paired legs on one said flange extending in the opposite direction from said paired legs on the other said flange;

said legs extending at an angle from said flanges so as to lie relatively parallel and spaced from the shield; and depending spring feet on said legs normally lying in spring pressed relationship against the shield counterbalancing the force of one said pair of legs against the other to eliminate levering-twisting force on said base plate and the attaching screw;

a plug being insertable in a socket by leading the plug between one pair of spring legs and feet by manually flexing them outwardly of the shield;

upon insertion of the plug in the socket and the release of manual flexure on said legs and feet, said legs flexing back against the plug and exerting force on the plug to hold it in the socket;

the holding force of said legs against one inserted plug being counterbalanced by said other legs and feet bearing against the shield to eliminate levering-twisting force on said base plate and the attaching screw;

when two plugs are so inserted the spring force of each said pair of legs bearing against an inserted plug counterbalancing the other to eliminate levering-twisting force on said base plate and the attaching screw.

2. In an apparatus as set forth in claim 1, said spaced legs and feet of at least one said pair lying parallel to one another.

3. In an apparatus as set forth in claim 1, said spaced legs and feet of at least one said pair diverging outwardly relative to one another from said upstanding flange on said base plate.

* * * * *